US011109739B2

(12) United States Patent
Sankaran Veerabhagu et al.

(10) Patent No.: US 11,109,739 B2
(45) Date of Patent: Sep. 7, 2021

(54) MULTI-DIRECTIONAL AIR DISTRIBUTION ASSEMBLY FOR A DISHWASHING APPLIANCE

(71) Applicant: Haier US Appliance Solutions, Inc., Wilmington, DE (US)

(72) Inventors: Thiyagarajan Sankaran Veerabhagu, Louisville, KY (US); Ramasamy Thiyagarajan, Louisville, KY (US); Timothy Kopera, Louisville, KY (US); Adam Christopher Hofmann, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 399 days.

(21) Appl. No.: 15/983,327

(22) Filed: May 18, 2018

(65) Prior Publication Data

US 2019/0350433 A1 Nov. 21, 2019

(51) Int. Cl.
*A47L 15/48* (2006.01)
*A47L 15/00* (2006.01)

(52) U.S. Cl.
CPC ..... *A47L 15/488* (2013.01); *A47L 15/0013* (2013.01); *A47L 15/486* (2013.01)

(58) Field of Classification Search
CPC ... A47L 15/488; A47L 15/0013; A47L 15/486
See application file for complete search history.

(56) References Cited

U.S. PATENT DOCUMENTS

2014/0170954 A1* 6/2014 Hintz ..... A47L 15/486 454/251

FOREIGN PATENT DOCUMENTS

| | | | |
|---|---|---|---|
| DE | 102014222541 | A1 | 5/2016 |
| JP | H0788073 | A | 4/1995 |
| JP | H11276415 | A | 10/1999 |
| KR | 100712277 | B1 | 4/2007 |

OTHER PUBLICATIONS

Machine Translation of DE 102014222541 to Lutz et al., May 2016. (Year: 2016).*

* cited by examiner

*Primary Examiner* — Benjamin L Osterhout
(74) *Attorney, Agent, or Firm* — Dority & Manning, P.A.

(57) ABSTRACT

A dishwashing appliance includes a tub defining a wash chamber. An inlet is defined in the tub and provides air flow into the wash chamber. A diverter disk is proximate the inlet and upstream of the wash chamber. The diverter disk is rotatable between a first position and a second position. The diverter disk permits air flow into the wash chamber via the inlet in a first direction when the diverter disk is in the first position and in a second direction when the diverter disk is in the second position.

16 Claims, 19 Drawing Sheets

MULTI-DIRECTIONAL AIR DISTRIBUTION ASSEMBLY FOR A DISHWASHING APPLIANCE

FIELD

The present subject matter relates generally to washing appliances, such as dishwashing appliances and, more particularly, to a venting assembly of a washing appliance.

BACKGROUND

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles, e.g., during the wet cycle.

In the drying cycle, air may be introduced into the wash chamber to promote drying of articles therein. However, air introduction assemblies typically provide a fixed direction of air flow which results in incomplete or inconsistent coverage of the articles in the wash chamber with the introduced air.

Accordingly, an improved air flow assembly for a dishwashing appliance which provides improved distribution of incoming air during a drying cycle would be welcomed.

BRIEF DESCRIPTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber. An inlet is defined in the tub and provides air flow into the wash chamber. A fan is configured to urge air through the inlet. A diverter disk is proximate the inlet and upstream of the wash chamber. The diverter disk is rotatable between a first position and a second position. The diverter disk permits air flow into the wash chamber via the inlet in a first direction when the diverter disk is in the first position and in a second direction when the diverter disk is in the second position. The diverter disk is configured to rotate between the first position and the second position in response to a flow of air from the fan.

In another embodiment, a dishwashing appliance is provided. The dishwashing appliance defines a vertical direction, a lateral direction, and a transverse direction which are mutually perpendicular. The dishwashing appliance includes a tub defining a wash chamber. A first inlet is defined in the tub and provides air flow into a lower region of the wash chamber. A second inlet is defined in the tub and spaced apart from the first inlet along the vertical direction. The second inlet provides air flow into an upper region of the wash chamber. The dishwashing appliance also includes a duct. The duct includes an inlet, a first outlet in fluid communication with the first inlet of the tub, and a second outlet in fluid communication with the second inlet of the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
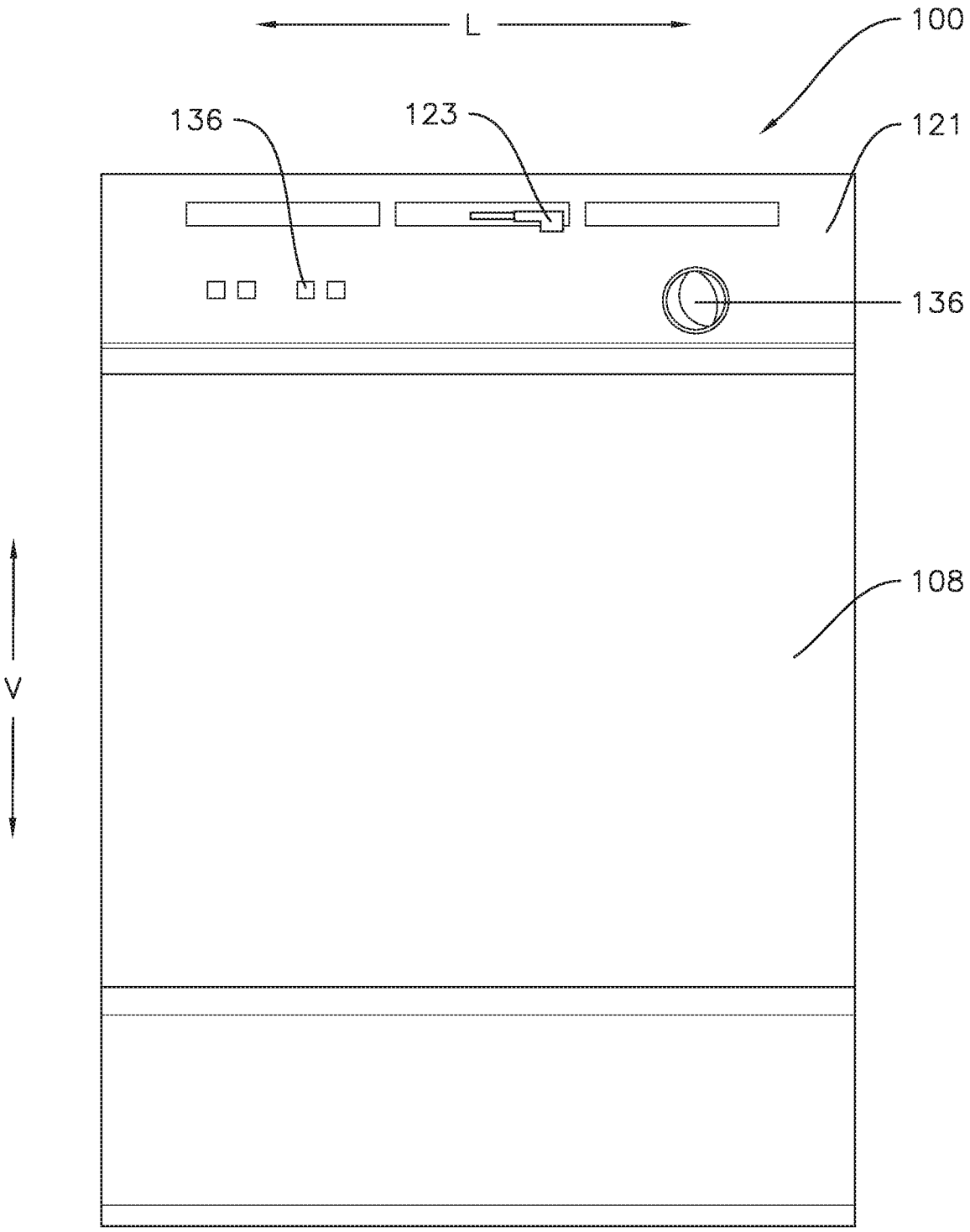
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
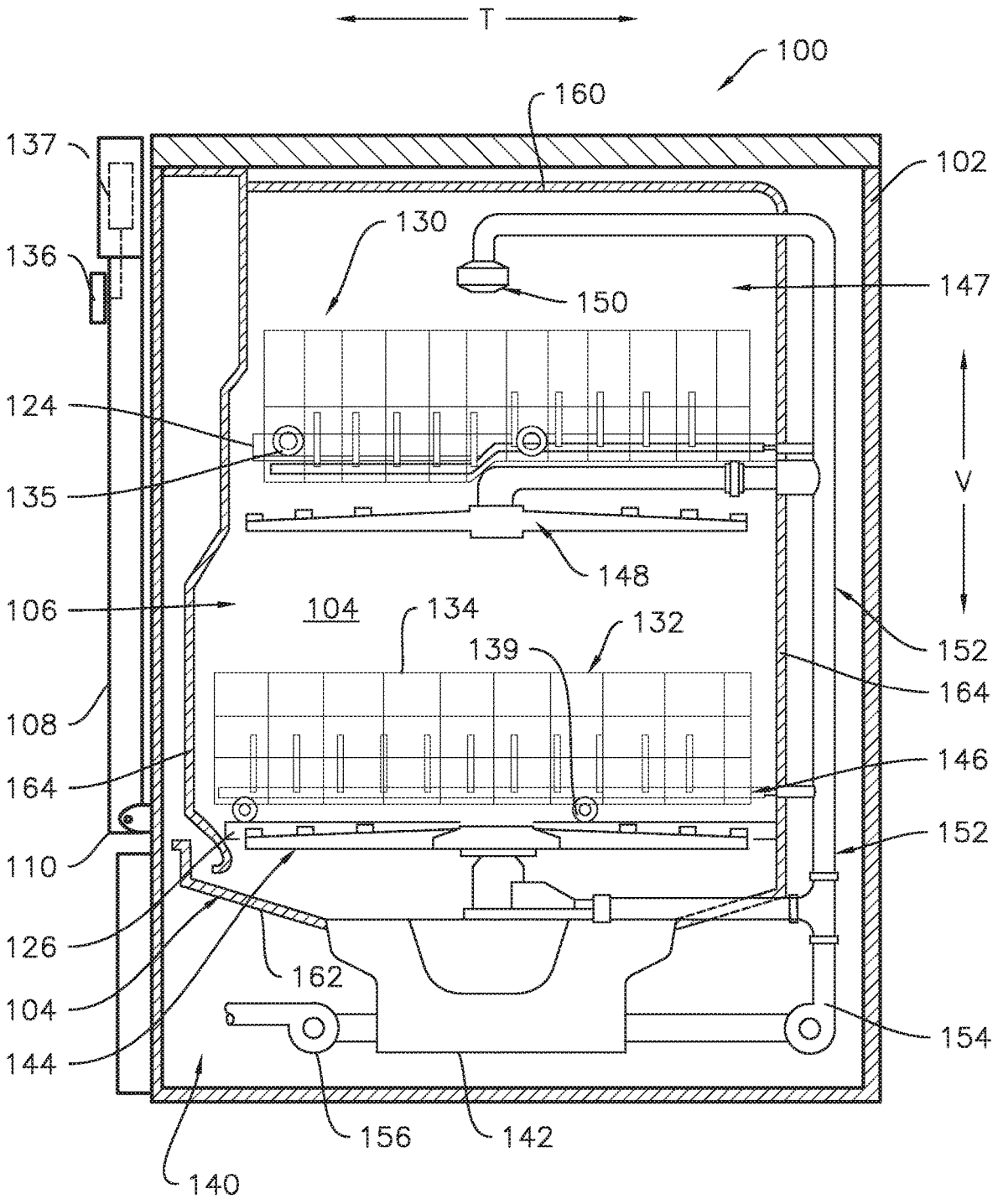
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region 147 of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash liquor) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
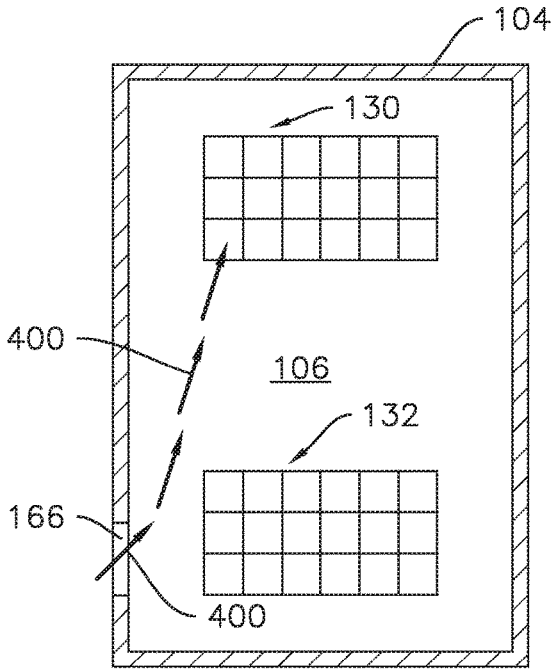
FIG. 3 provides a schematic view of a dishwashing appliance including an air distribution system in a first position according to one or more embodiments of the present subject matter.
Figure 4:
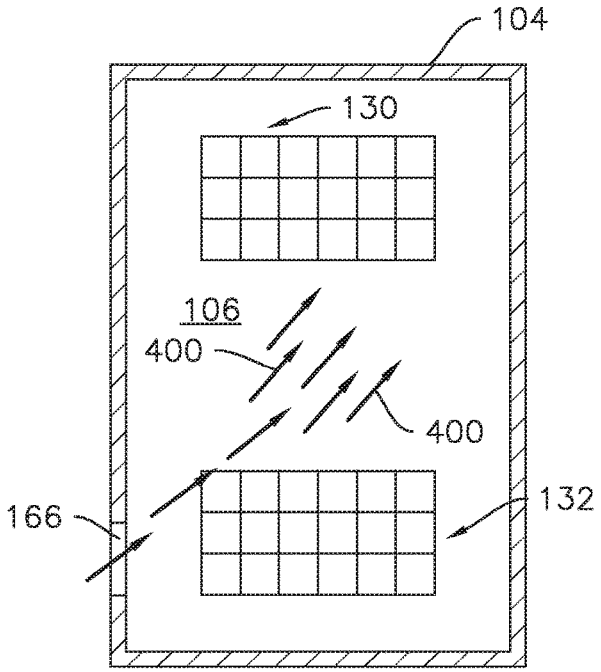
FIG. 4 provides a schematic view of the dishwashing appliance of FIG. 3 with the air distribution system in a second position.
Figure 5:
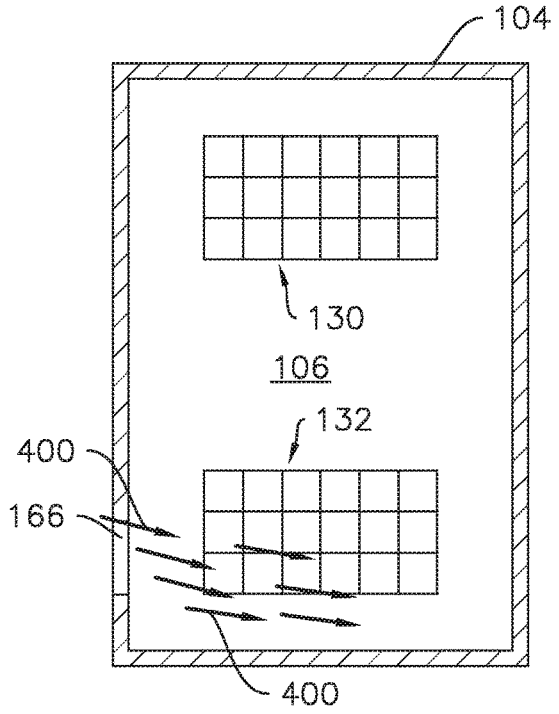
FIG. 5 provides a schematic view of the dishwashing appliance of FIG. 3 with the air distribution system in a third position.
Figure 6:
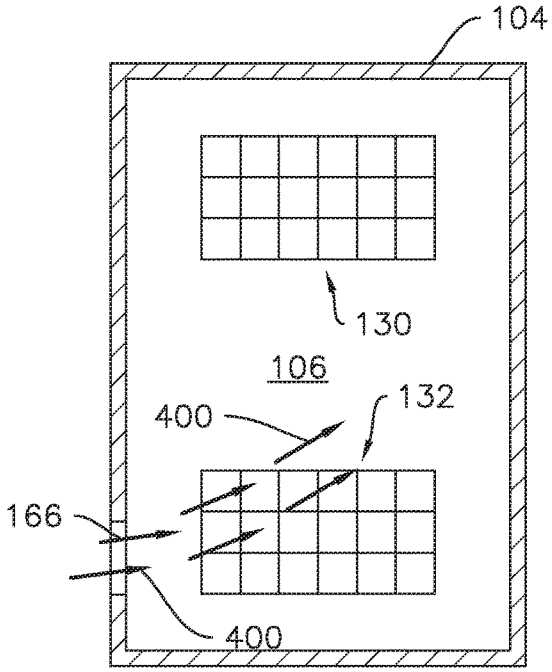
FIG. 6 provides a schematic view of the dishwashing appliance of FIG. 3 with the air distribution system in a fourth position.

Turning now to FIGS. 3 through 6, a flow of air 400 may be provided in order to promote drying of the wash chamber 106 and/or of wet articles therein. The flow of air 400 may travel through the wash chamber 106 to promote drying of dishes or other articles located in rack assemblies 130 and 132 within the wash chamber 106, whereupon the air 400 may impart thermal energy to and/or receive moisture from the articles and/or the wash chamber 106. More particularly, the dishwashing appliance 100 may be configured to provide air flow into the wash chamber 106 within the tub 104 alternately in four different directions during a drying cycle. As shown in FIG. 3, air 400 may flow into the wash chamber 106 via an inlet 166 in a first direction which is predominantly along the vertical direction V such that the air 400 is predominantly directed into the upper region 147 and onto articles in the upper rack 130. As shown in FIG. 4, air 400 may flow into the wash chamber 106 via the inlet 166 in a second direction which is oblique to the vertical direction V, such that the air 400 is directed approximately equally onto articles in each rack 130 and 132. As shown in FIG. 5, air 400 may flow into the wash chamber 106 via the inlet 166 in a third direction which is predominantly perpendicular to the vertical direction V such that the air 400 is predominantly directed into the lower region 146 and onto articles in the lower rack 132. As shown in FIG. 6, air 400 may flow into the wash chamber 106 via the inlet 166 in a third direction which is oblique to the vertical direction V such that the air 400 is directed into both the upper region 147 and the lower region 146, but mostly into the lower region 146, e.g., with a ratio of about 2:1 in favor of the lower region 146. In other embodiments, the fourth direction may favor the upper region 147 instead of the lower region 146 and/or a fifth position may be provided where the air flow ratio between the upper and lower regions 147 and 146 is inverse of the ratio in the fourth position. In various exemplary embodiments, the drying cycle may include sequentially providing air flow into the wash chamber 106 in at least two different directions, such as in each of the first, second, third, and fourth directions. The air flow may be provided in any order, e.g., the sequence may begin with any of the first or second directions, as well as the third, fourth, or fifth directions in embodiments where more than two air flow directions are provided. In at least some embodiments, the dishwashing appliance 100 may be configured to provide generally the same air flow rate into the wash chamber 106 in each direction.

Figure 8:
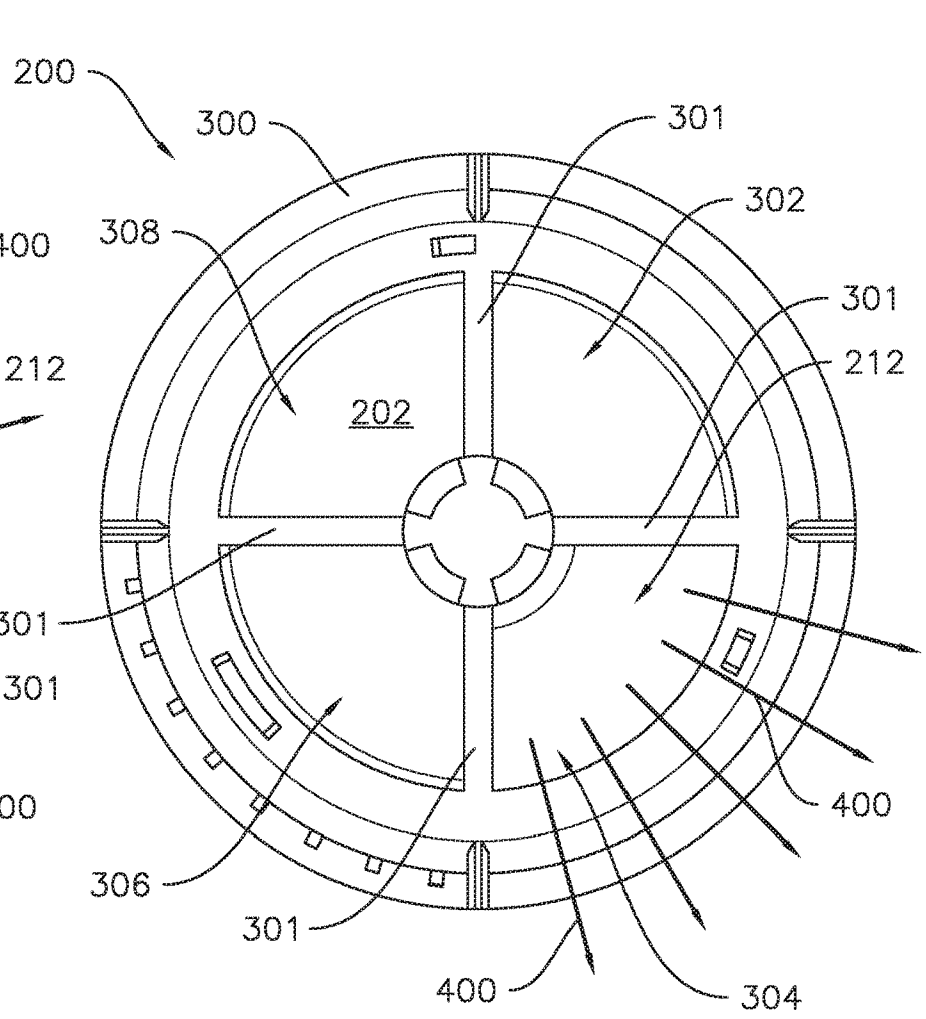
FIG. 8 provides a front view of the air distribution system of FIG. 7 in the second position.
Figure 7:
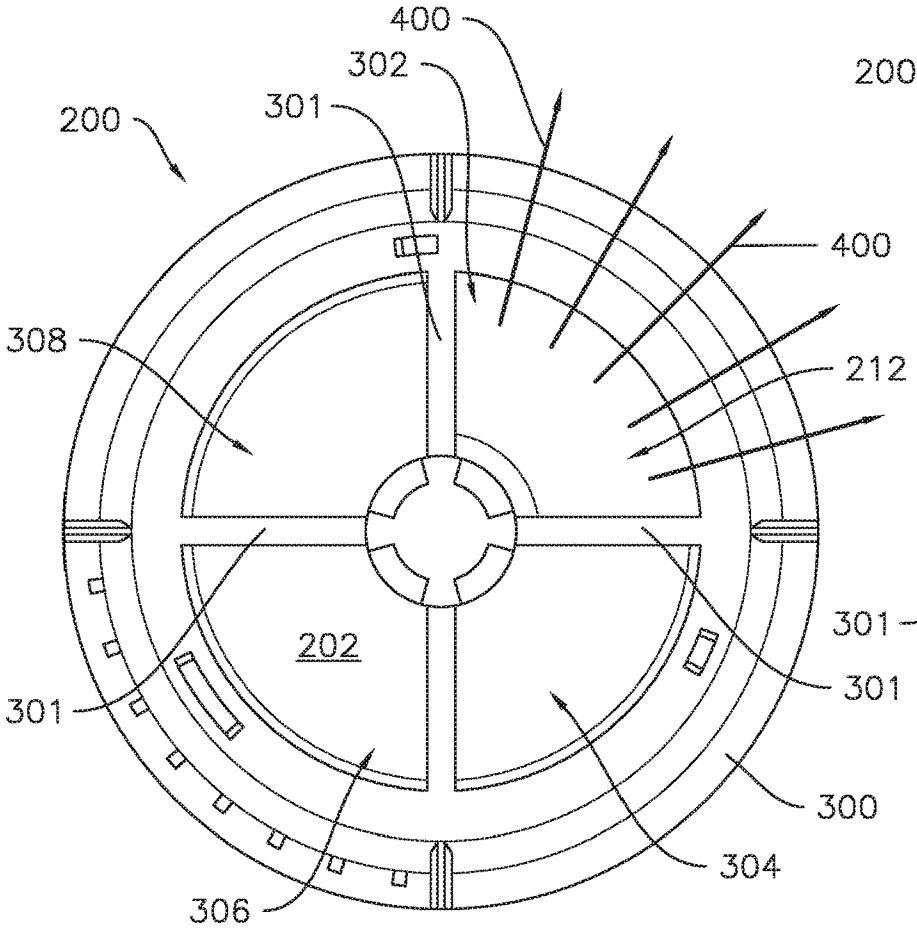
FIG. 7 provides a front view of an air distribution system for a dishwashing appliance according to one or more embodiments of the present subject matter in the first position.
Figure 10:
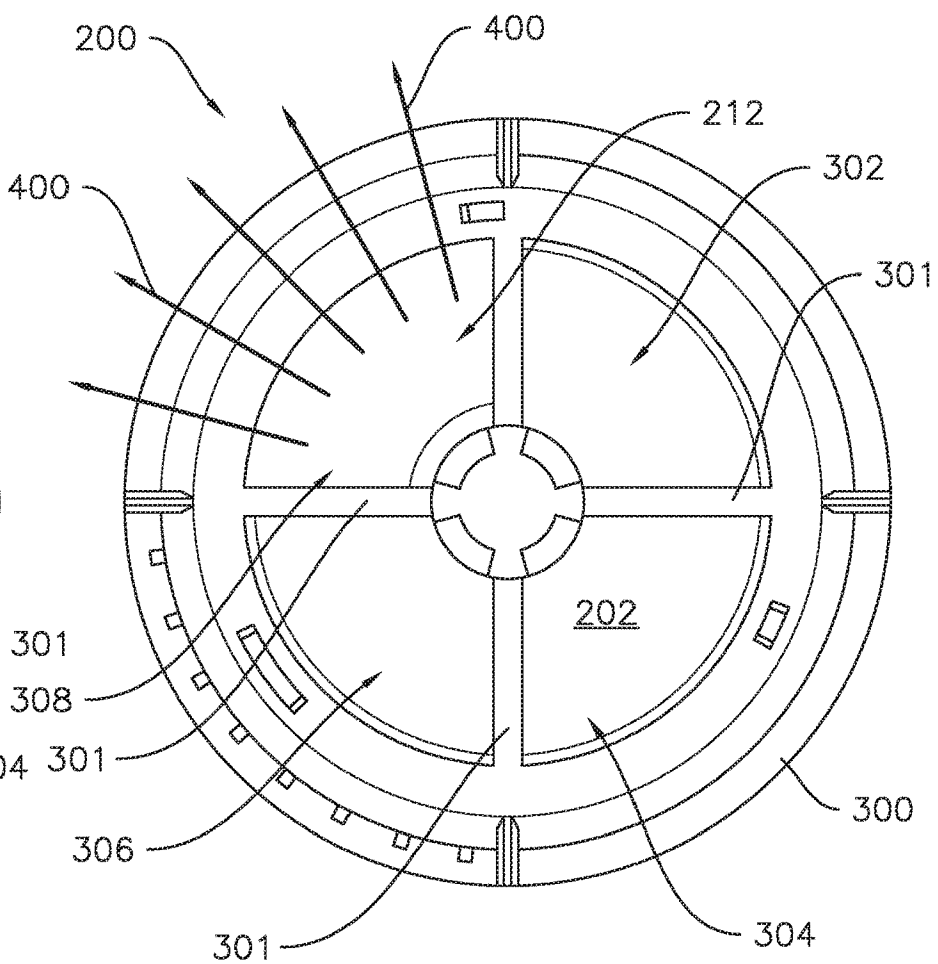
FIG. 10 provides a front view of the air distribution system of FIG. 7 in the fourth position.
Figure 9:
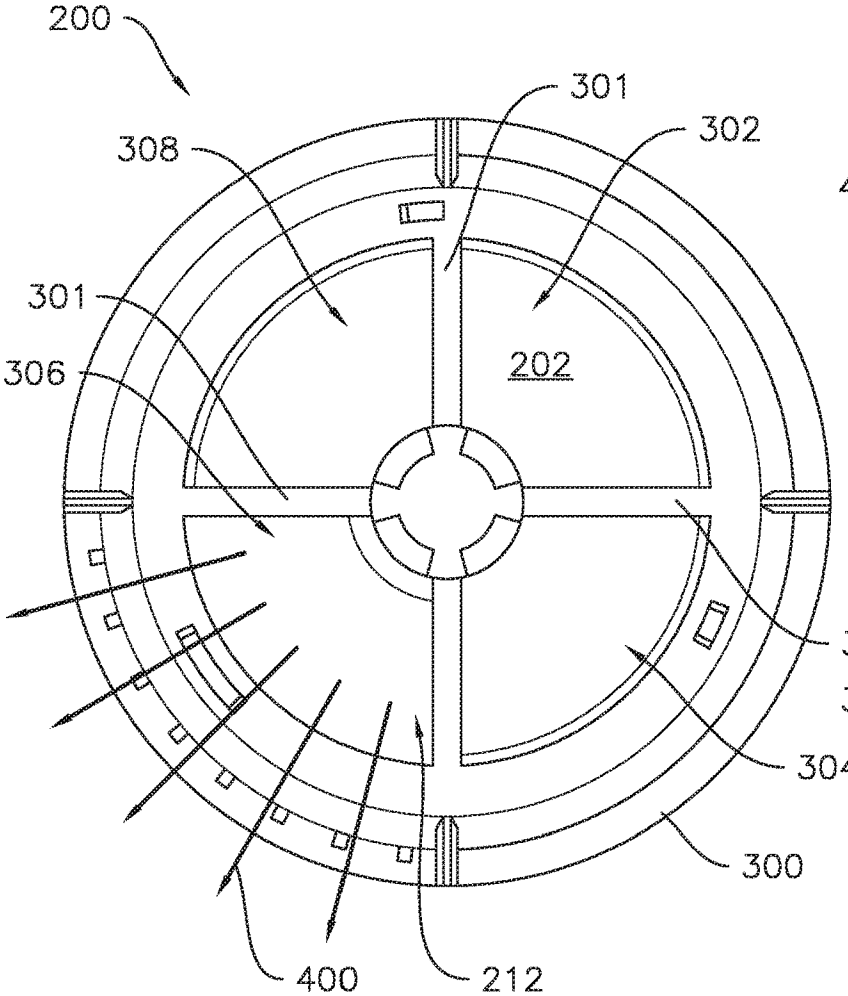
FIG. 9 provides a front view of the air distribution system of FIG. 7 in the third position.

As shown in FIGS. 7 through 10, the air 400 may be selectively directed in different directions, e.g., one of the four different directions described above, by an air distribution assembly 200 including a diverter disk 202 and a vent 300. The diverter disk 202 may be rotatably mounted in or proximate to the vent 300. In at least some embodiments, the diverter disk 202 may be passively rotatable. For example, the diverter disk 202 may not be actively driven, e.g. by a motor, between the first and second positions. For example, the diverter disk 202 may rotate between the first and second positions (and other subsequent positions as well, such as those described above) in response to air flow driven by a fan 250 (e.g., FIGS. 22 and 26) upstream of the diverter disk 202. The vent 300 may be located at the inlet 166 into the wash chamber 106. With the vent 300 located at the inlet 166, the diverter disk 202 mounted in or to the vent 300 is disposed proximate the inlet 166 and upstream of the wash chamber 166. In some embodiments, for example as illustrated in FIGS. 7 through 10, the vent 300 may comprise a plurality of arms 301 which define multiple outlets of the vent. For example, the arms 301 may divide the vent 300 into four quadrants 302, 304, 306, and 308, as shown in FIGS. 7 through 10. In some embodiments, the diverter disk 202 may include a single aperture 212. For example, in some embodiments, the diverter disk 202 may be circular and the aperture 212 may extend along an arc of approximately ninety degrees. In embodiments where the vent 300 includes the four quadrants 302, 304, 306, and 308 and the diverter disk 202 includes the single aperture 212, the diverter disk 202 may rotate through four positions to align the aperture 212 with each quadrant 302, 304, 306, and 308 of the vent 300 in sequence. The four positions may be spaced apart by about ninety degrees. As also described above with reference to FIGS. 3 through 6, air 400 may flow in the first direction when the aperture 212 of the diverter disk 202 is aligned with the first quadrant 302 of the vent 300, e.g., as shown in FIG. 7, where the diverter disk 202 is in a first position. As shown in FIG. 8, air 400 may flow in the second direction when the diverter disk 202 is in a second position where the aperture 212 of the diverter disk 202 is aligned with the second quadrant 304 of the vent 300. As shown in FIG. 9, air 400 may flow in the third direction when the aperture 212 of the diverter disk 202 is in a third position and aligned with the third quadrant 306 of the vent 300. As shown in FIG. 10, air 400 may flow in the fourth direction when the aperture 212 of the diverter disk 202 is in a fourth position and aligned with the fourth quadrant 308 of the vent 300. The air distribution assembly 200 may be configured to provide generally the same air flow rate into the wash chamber in each direction. For example, the quadrants 302, 304, 306, and 308 of the vent may be generally equivalent in size, in particular in cross-sectional area, such that the rate of air flow through the vent 300 is generally the same when the aperture 212 is aligned with each quadrant 302, 304, 306, and 308.

Figure 11:
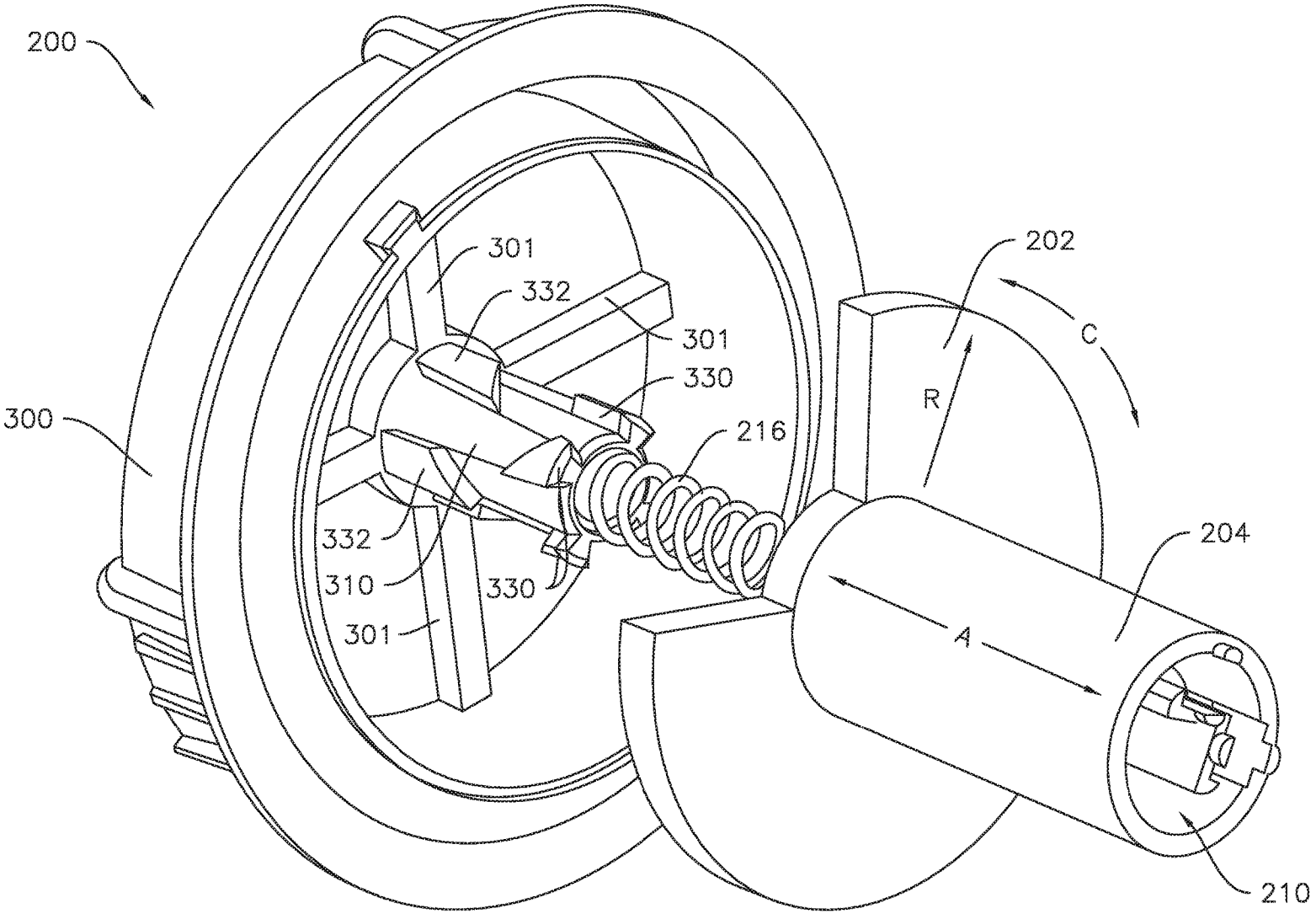
FIG. 11 provides a rear perspective view of a vent and a diverter of an air distribution system for a dishwashing appliance according to one or more embodiments of the present subject matter.
Figure 12:
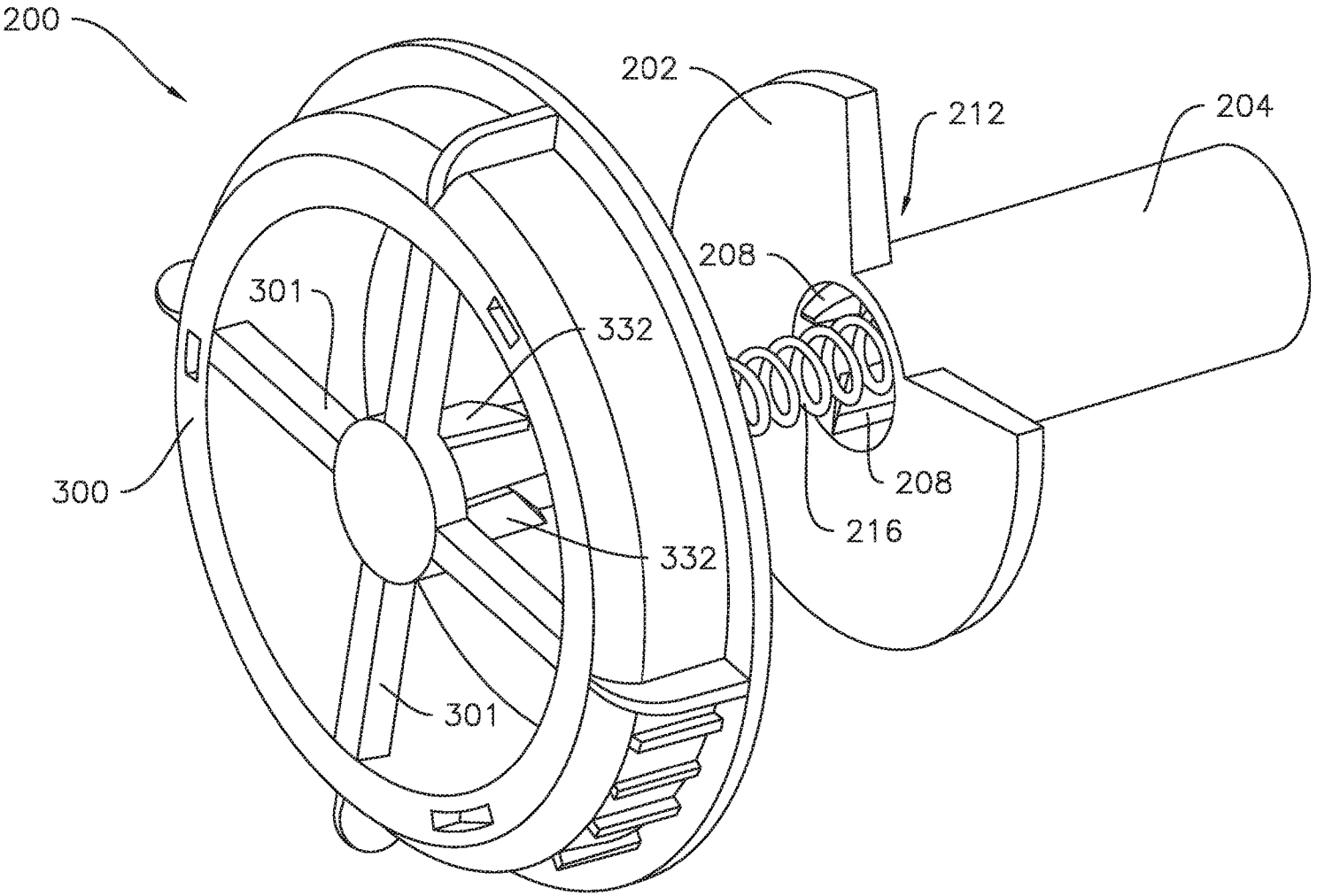
FIG. 12 provides a front perspective view of the vent and diverter of FIG. 11.

FIG. 11 provides an exploded view of an exemplary air distribution assembly 200 including a diverter disk 202, vent 300, and a biasing element 216 between the diverter disk 202 and the vent 300. The view of FIG. 11 is looking downstream with respect to the flow of air through the air distribution assembly 200. FIG. 12 provides an exploded view of the air distribution assembly of FIG. 11 looking upstream with respect to the flow of air through the air distribution assembly 200. As seen in FIGS. 11 and 12, the diverter disk 202 may define an axial direction A, a radial direction R, and a circumferential direction C. More particularly, the diverter disk 202 includes a generally circular main body with at least one aperture 212 defined therein, the circumferential direction C defined by an outermost perimeter of the disk 202, and a cylindrical shaft 204 that extends along the axial direction A. The vent 300 may include a cylindrically-shaped boss 310 which extends along the axial direction A and includes a plurality of guide elements 330 and 332 that extend radially outward from the boss 310 and are spaced apart from each other along axial and circumferential directions A and C. The cylindrical shaft 204 may be configured to interengage with the boss 310, and in particular cams 208 (FIG. 12) on the cylindrical shaft 204 may engage the guide elements 330 and 332 on the boss 310, such that the diverter disk 202 is rotatable about the axial direction A, e.g., along the circumferential direction C, relative to vent 300 and movable back and forth along axial direction A, e.g., in a first direction along the axial direction and in a second direction opposite the first direction along the axial direction, as described in more detail below.

Figure 22:
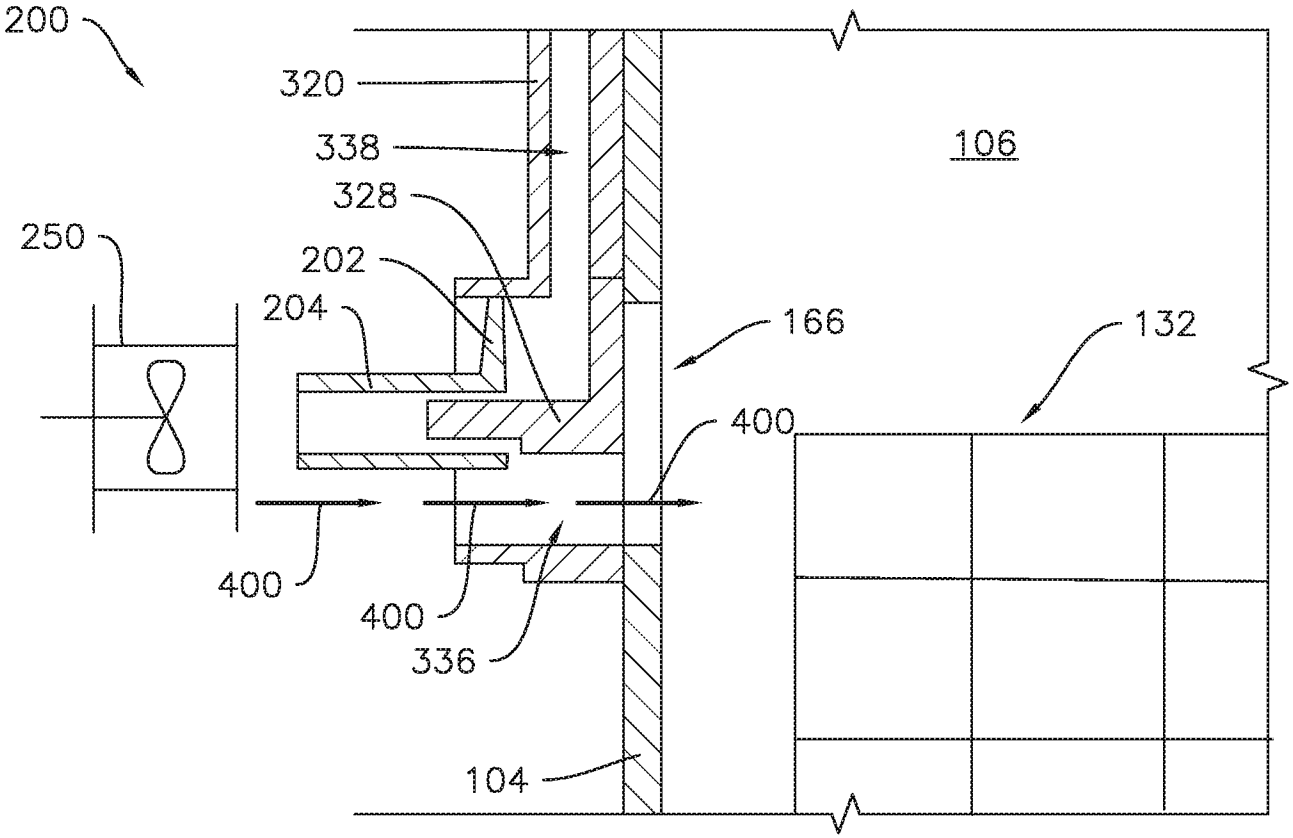
FIG. 22 provides a section view of a portion of the dishwashing appliance of FIG. 21 with a diverter in a first position.
Figure 26:
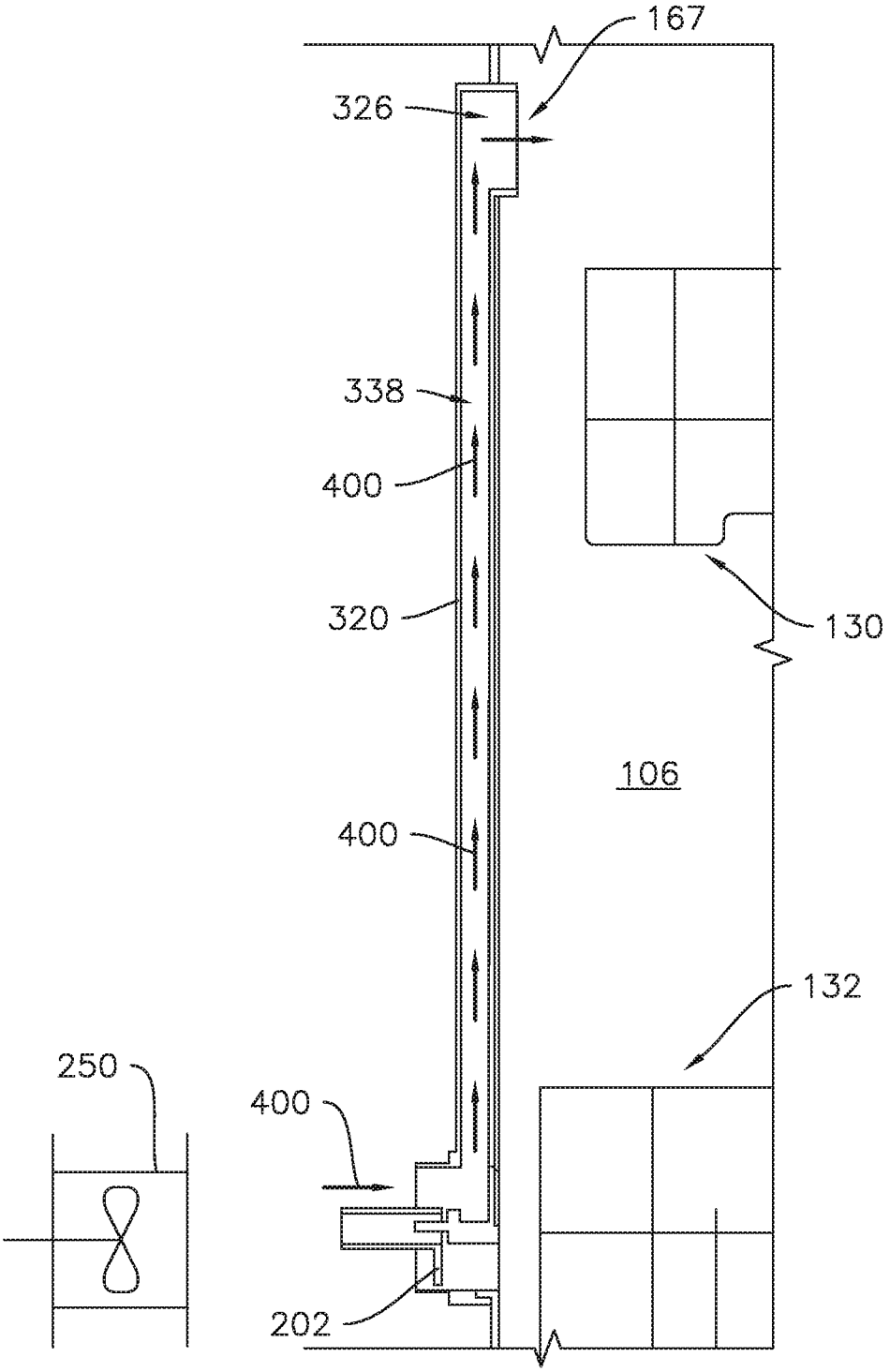
FIG. 26 provides a section view of a portion of the dishwashing appliance of FIG. 21 with the diverter in the second position.

In various embodiments, the diverter disk 202 may be configured to move in the first direction along the axial direction A, e.g., towards the vent 300, by a motor (not shown) or by the force of air flowing through the air distribution assembly 200, e.g., air urged by a fan 250 (FIGS. 22 and 26). In some embodiments, the biasing element 216 may be configured and arranged to bias the diverter disk 202 along the axial direction A in a second direction opposite the first direction. The diverter disk 202 may rotate about the axial direction A, e.g., along the circumferential direction C, as it translates long the axial direction A. For example, the diverter disk 202 may rotate halfway between the first and second positions when it moves in the second direction and may complete the rotation when the diverter disk 202 moves in the first direction along the axial direction in response to the air flow from the fan 250.

Figure 13:
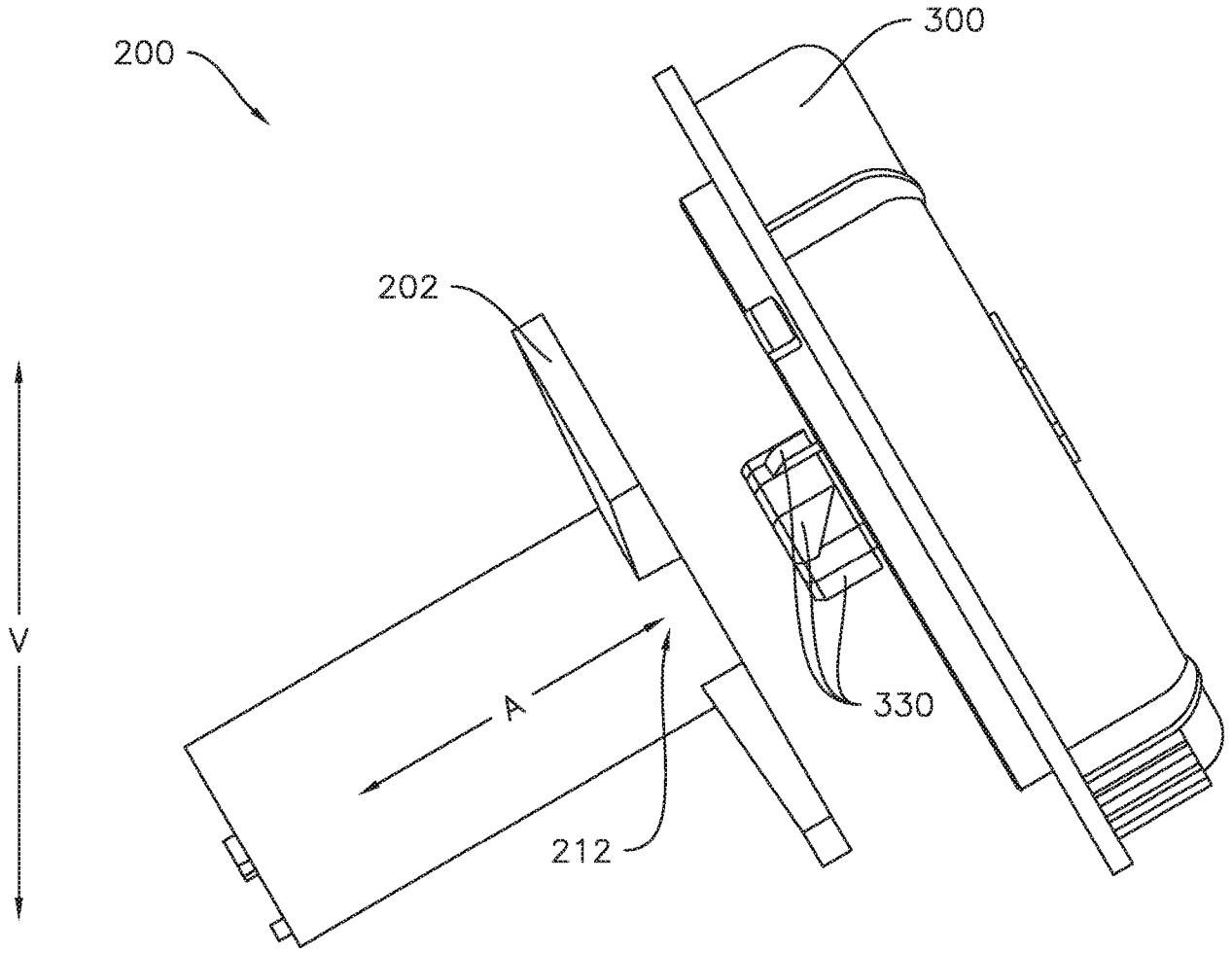
FIG. 13 provides a side view of a vent and a diverter of an air distribution system for a dishwashing appliance according to one or more additional embodiments of the present subject matter.
Figure 20:
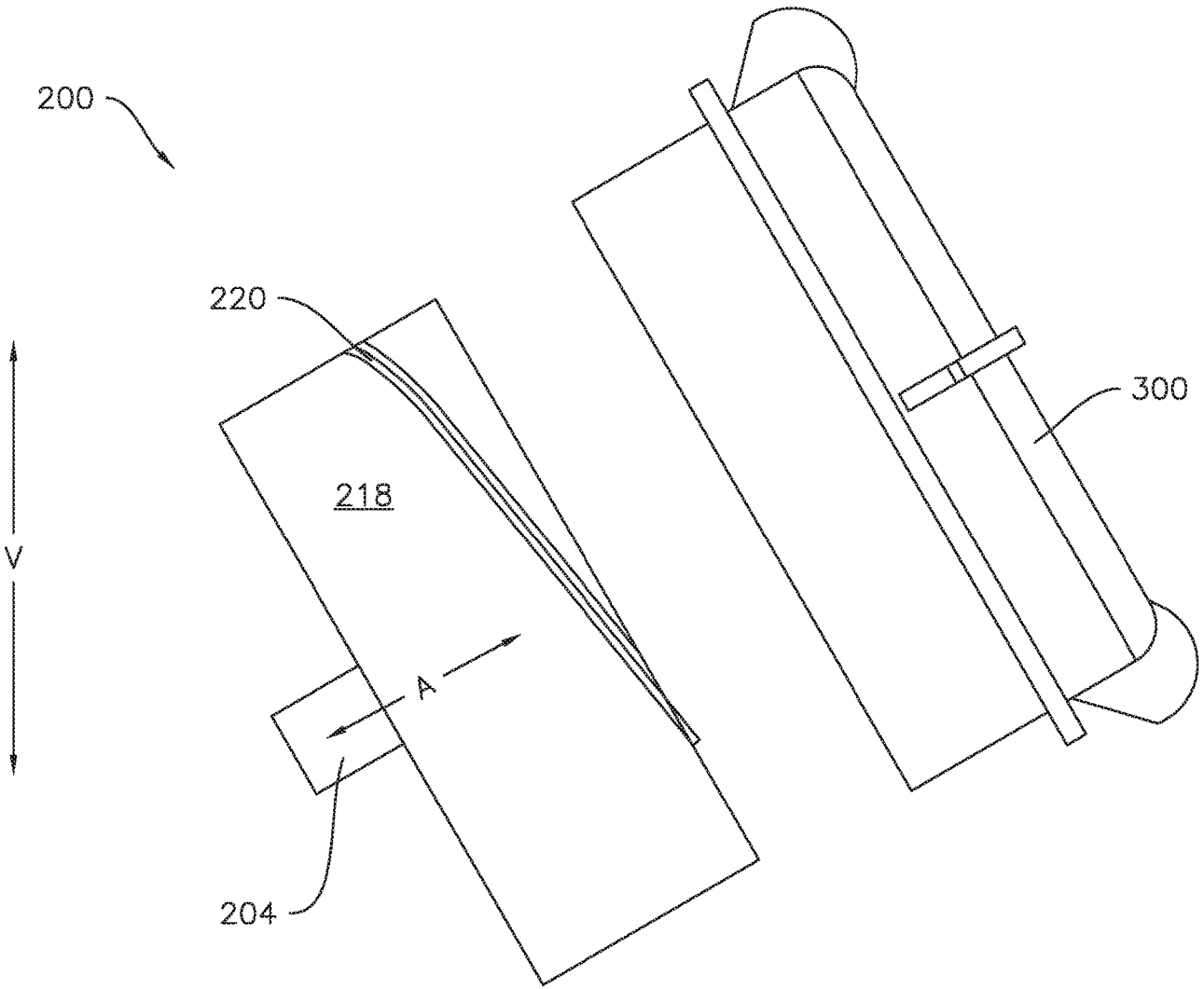
FIG. 20 provides a side view of a vent and a diverter of an air distribution system for a dishwashing appliance according to one or more additional embodiments of the present subject matter.

As shown in FIGS. 13 and 20, in some embodiments the air distribution assembly 200 may be positioned within the dishwashing appliance 100 such that the axial direction A of the diverter disk 202 is oblique to the vertical direction V. In such embodiments, the diverter disk 202 may thusly be configured to translate along the axial direction A in the second direction opposite the first direction due to gravity when the axial direction A is oblique to the vertical direction V.

Figure 15:
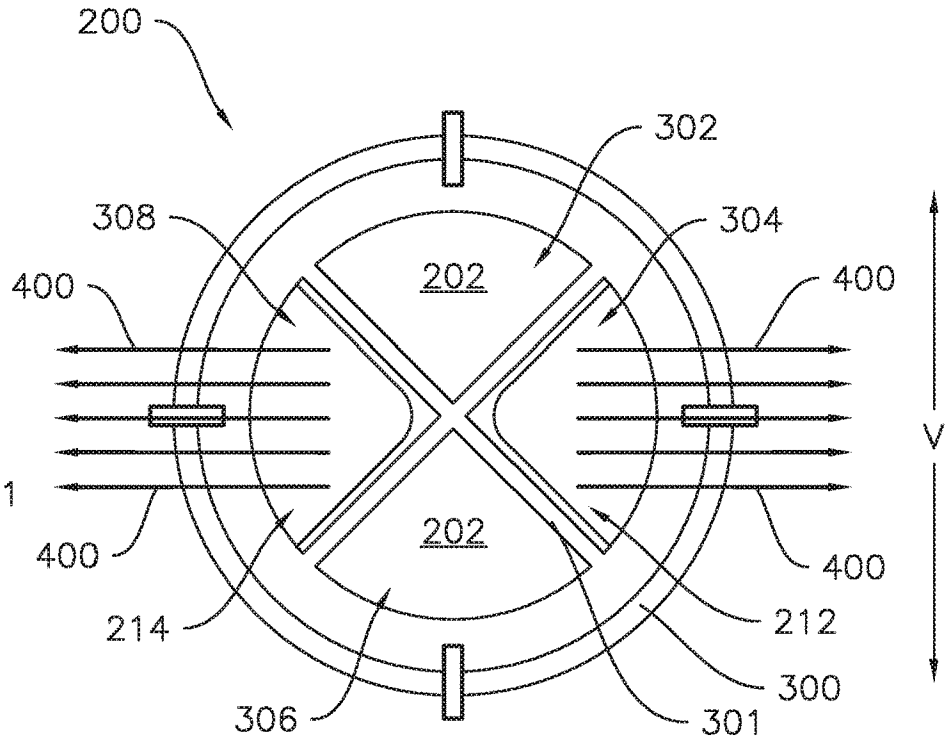
FIG. 15 provides a front view of the air distribution system of FIG. 14 in a second position.
Figure 14:
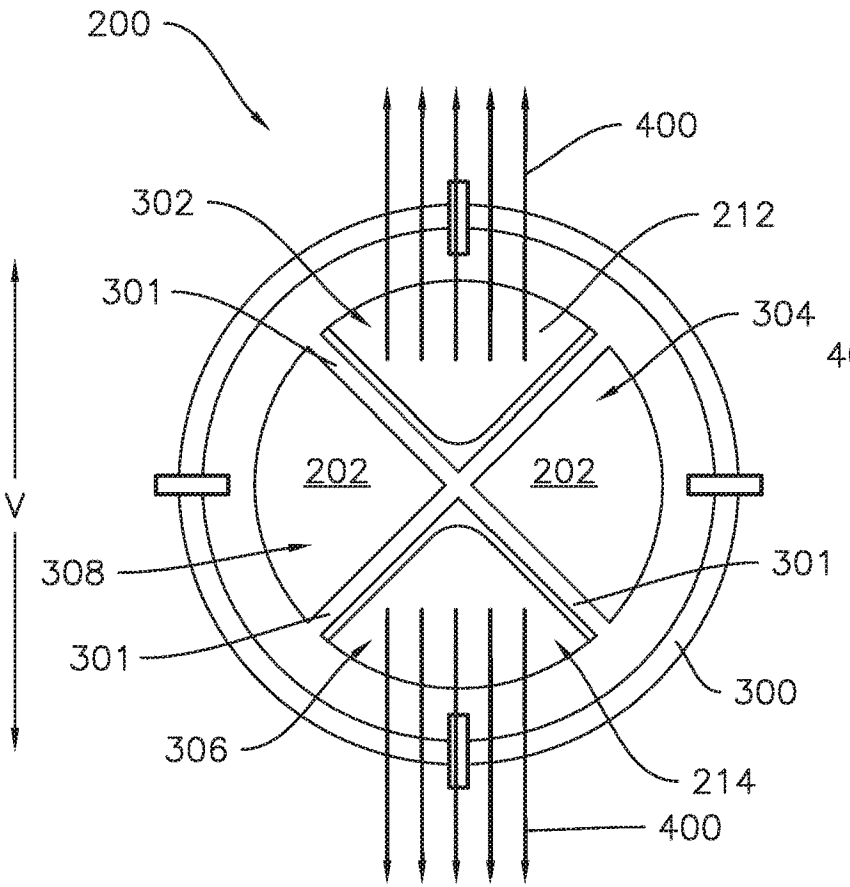
FIG. 14 provides a front view of an air distribution system for a dishwashing appliance according to one or more further additional embodiments of the present subject matter in a first position.
Figure 16:
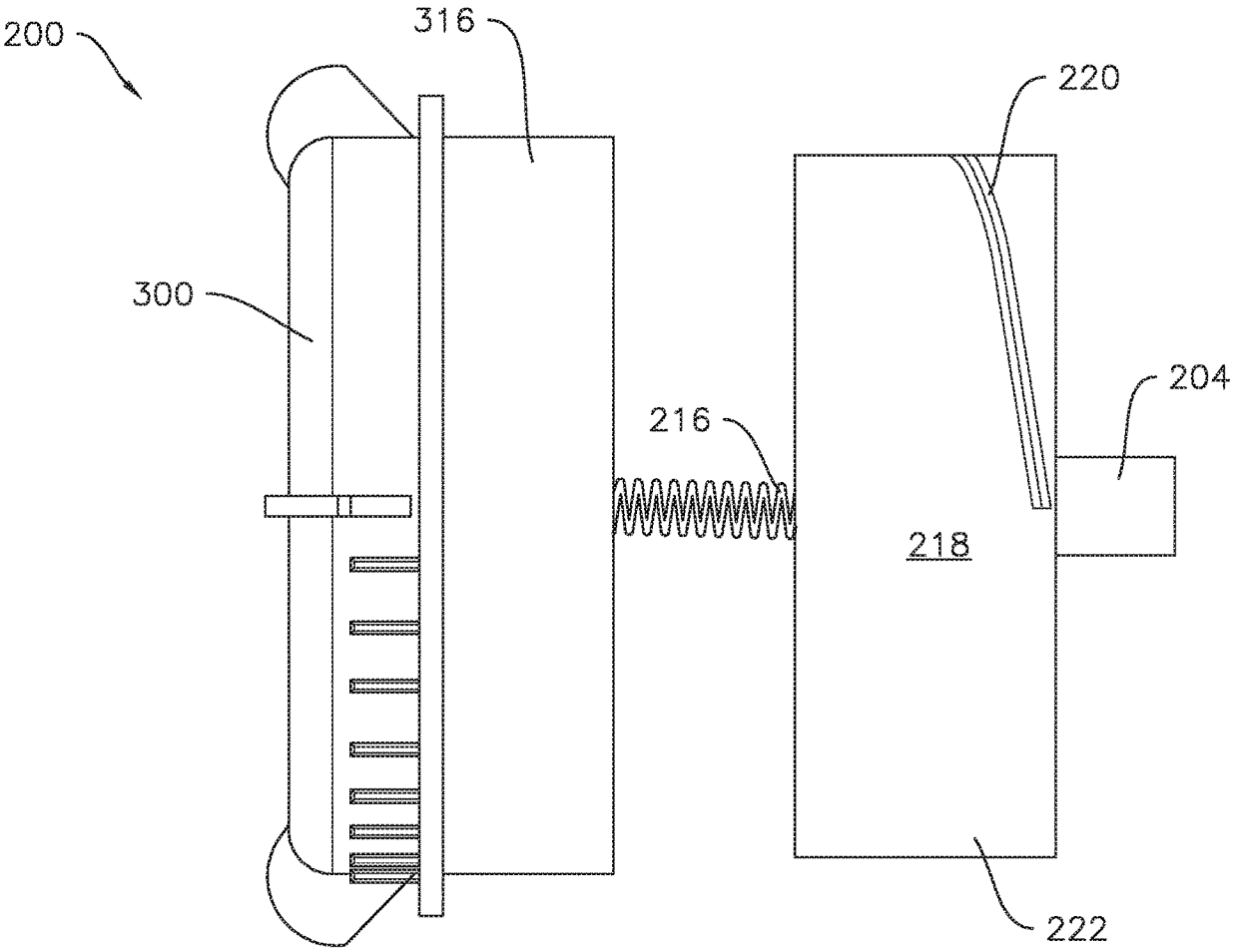
FIG. 16 provides a side view of the air distribution system of FIG. 14.
Figure 17:
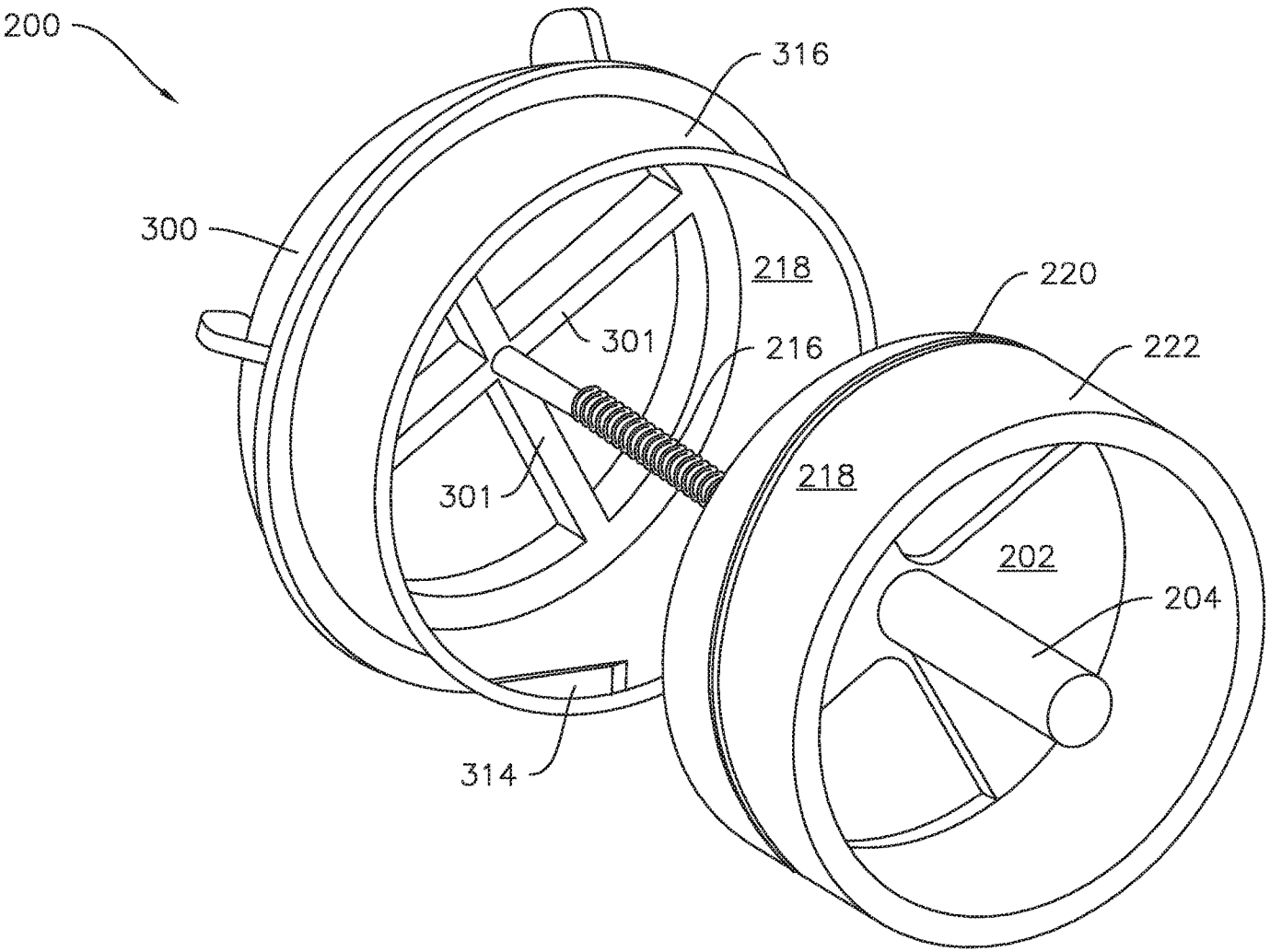
FIG. 17 provides a rear perspective view of the air distribution system of FIG. 14.

In some embodiments, the air flow distribution assembly 200 may be configured to provide only two directions of air flow. For example, the first direction may be as shown in FIG. 14 and the second direction may be as shown in FIG. 15. In such embodiments, the first direction of airflow may be generally vertical, e.g., generally along the vertical direction V, and the second direction may be generally horizontal, e.g., generally perpendicular to the vertical direction V, such as along one of the lateral direction L and the transverse direction T. In such embodiments, the diverter disk 202 may include a first aperture 212 and a second aperture 214. The diverter disk 202 may be configured to provide generally the same air flow rate into the wash chamber 106 in each of the first direction and the second direction. For example, the first and second apertures 212 and 214 may be generally equivalent in size, e.g., cross-sectional area. For example, in some embodiments where the first aperture 212 extends along an arc of approximately ninety degrees along the circumferential direction C, the second aperture 214 may extend along an equivalent arcuate extent as the first aperture 212.

Additionally, the quadrants 302, 304, 306, and 308 of the vent 300 may be generally equivalent in size. Further, in embodiments such as illustrated in FIGS. 14 and 15, the quadrants 302, 304, 306, and 308 may be oriented such that a first pair of opposing quadrants, e.g., first quadrant 302 and third quadrant 306, are aligned along the vertical direction V, and a second pair of opposing quadrants, e.g., second quadrant 304 and fourth quadrant 308, are aligned along a direction perpendicular to the vertical direction V. In such embodiments, the diverter disk 202 may be rotatable between a first position where the first aperture 212 is aligned with the first quadrant 302 and the second aperture 214 is aligned with the third quadrant 306, to direct the air 400 vertically, as shown in FIG. 14, and a second position where the first aperture 212 is aligned with the second quadrant 304 and the second aperture 214 is aligned with the fourth quadrant 308, to direct the air horizontally, as shown in FIG. 15.

As shown in FIGS. 16 through 20, the diverter disk 202 may include a cylindrical shroud 222. The cylindrical shroud 222 may define an external cylindrical surface 218 with a helical groove 220 extending around the external cylindrical surface 218. In such embodiments, the vent 300 may include an internal cylindrical surface 312 (FIG. 17) and a helical thread 314 (FIG. 17) on the internal cylindrical surface 312. As will be understood by those of ordinary skill in the art, the diverter disk 202 and the vent 300 may thereby be threadedly engaged, e.g., the helical thread 314 on the vent 300 may be configured to engage the helical groove 220 on the external cylindrical surface 218 of the diverter disk 202 such that the diverter disk 202 is rotatable relative to the vent 300 along a path guided and defined by the groove 220 and the thread 314. For example, in the embodiments illustrated in FIGS. 16 through 20, the diverter disk 202 is rotatable between a first position and a second position, e.g., as described above with respect to FIGS. 14 and 15.

Figure 18:
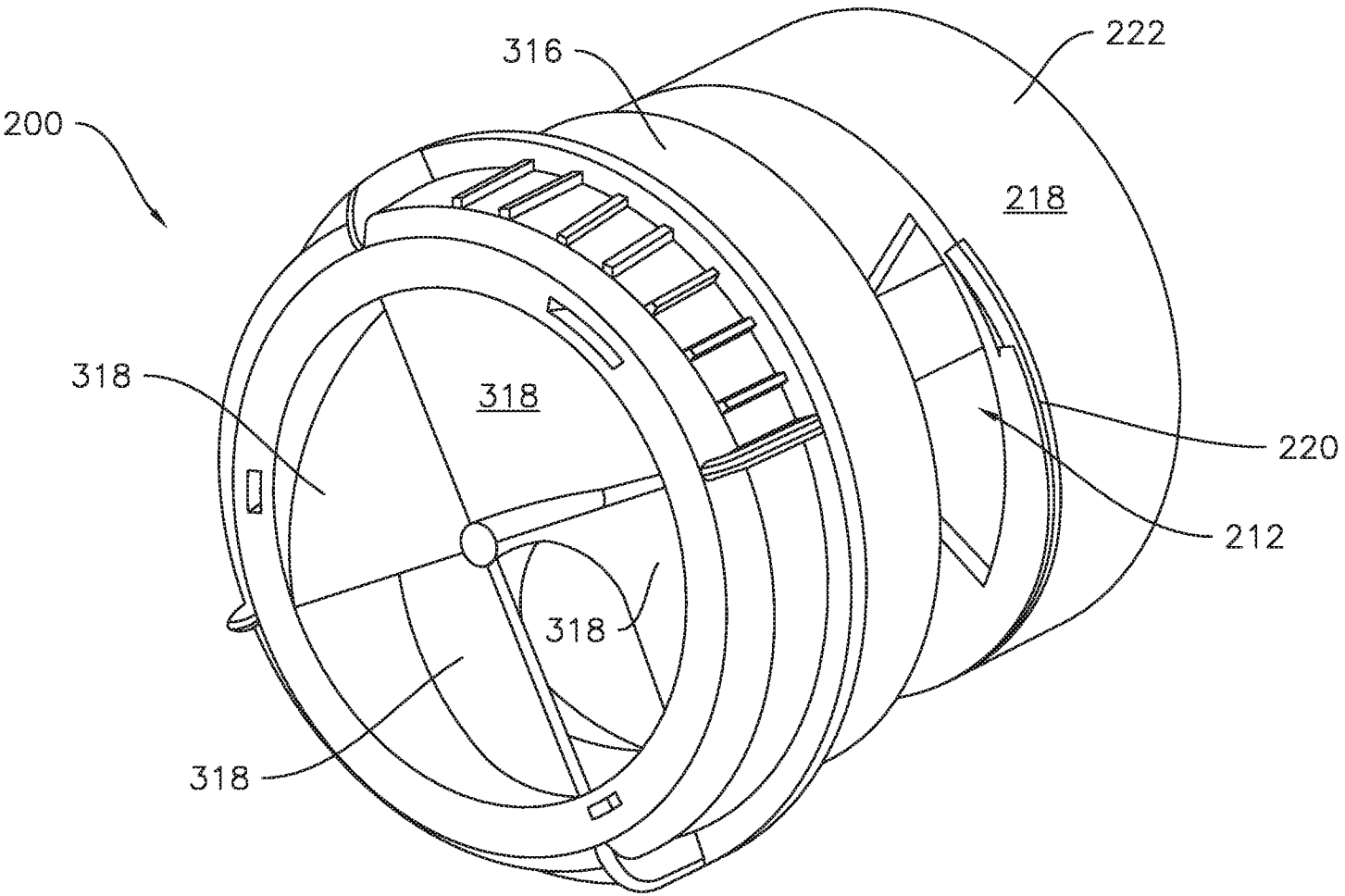
FIG. 18 provides a front perspective view of a vent and a diverter of an air distribution system for a dishwashing appliance according to one or more still further embodiments of the present subject matter.
Figure 19:
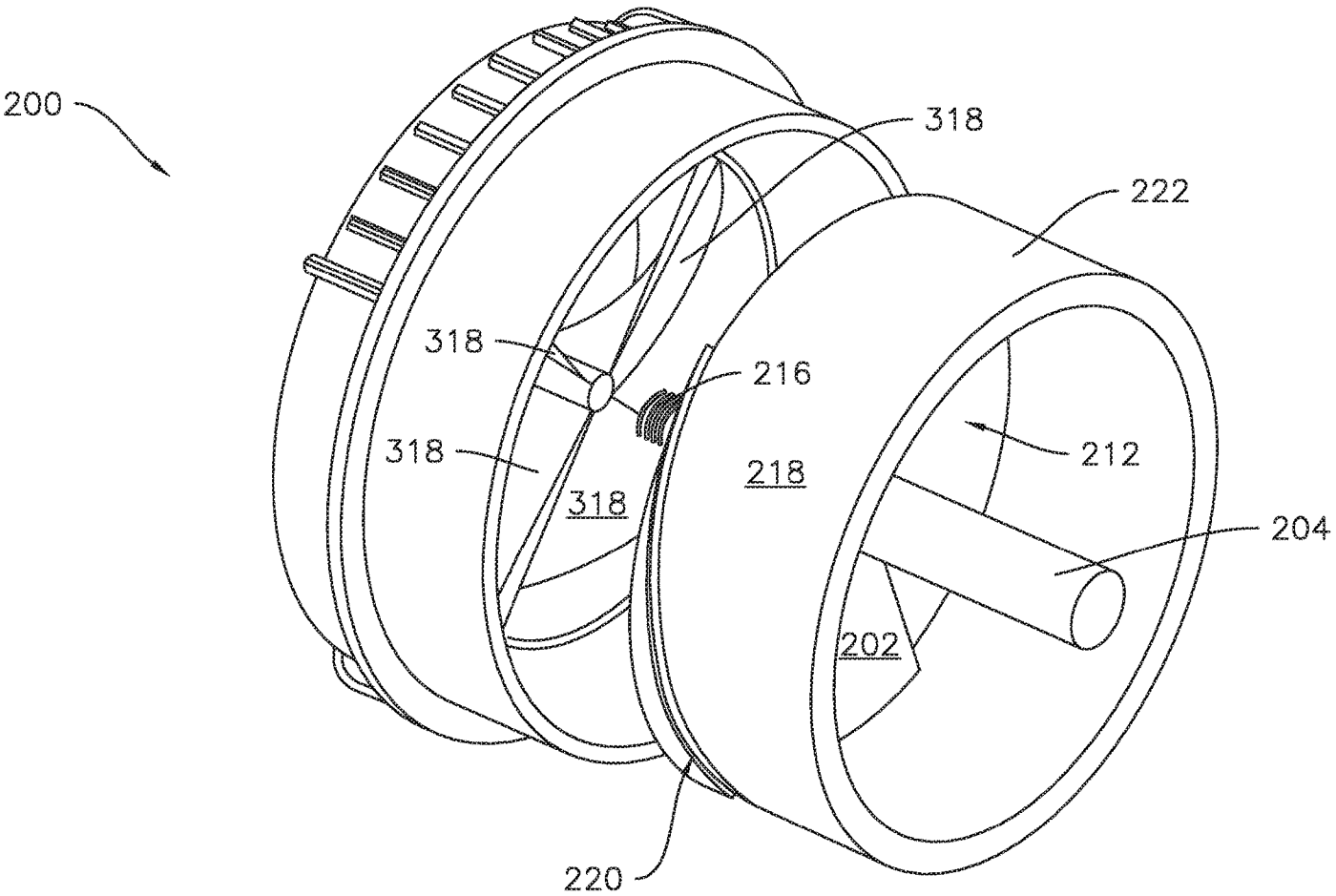
FIG. 19 provides a rear perspective view of the vent and diverter of FIG. 18.

In some embodiments, as shown in FIGS. 18 and 19, the vent 300 may include a plurality of swirler vanes 318. As is generally understood in the art, the swirler vanes 318 may each define a partial helical surface which imparts a swirl to air flowing out of the vent 300, e.g., the air may be directed at least partially along the circumferential direction C by the swirler vanes 318.

Figure 21:
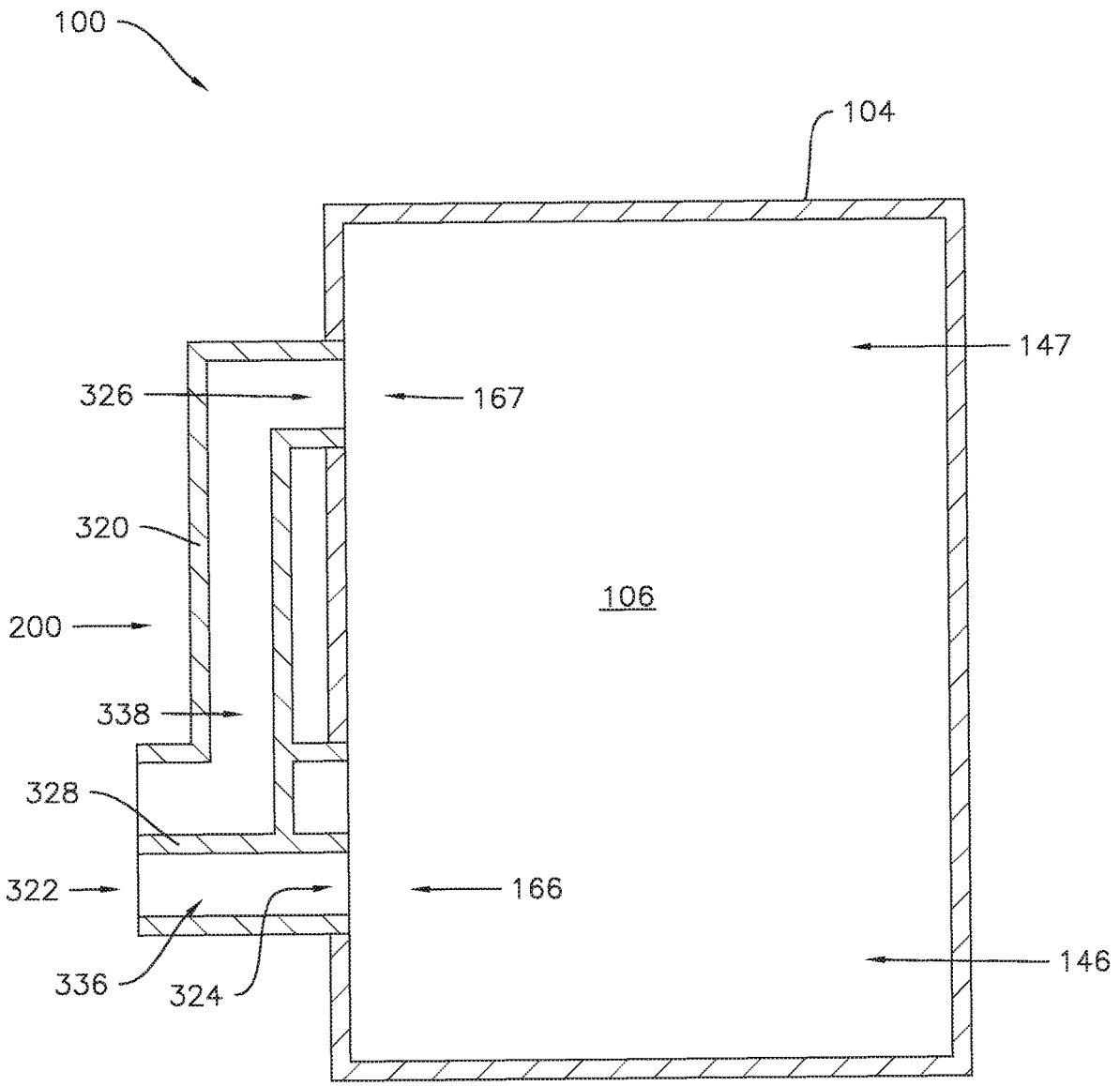
FIG. 21 provides a schematic view of a dishwashing appliance according to one or more additional embodiments of the present subject matter.

In some embodiments, as shown in FIG. 21, the inlet 166 may be a first inlet and the dishwashing appliance 100 may also include a second inlet 167 spaced apart from the first inlet 166 along the vertical direction V. For example, the first inlet 166 may be positioned to provide air flow into the lower region 146 of the wash chamber 106 and the second inlet 167 may be positioned to provide air flow into the upper region 147 of the wash chamber 106. In such embodiments, the dishwashing appliance 100 may also include a duct 320. The duct 320 may include an inlet 322, a first outlet 324 in fluid communication with the first inlet 166 of the tub 104, and a second outlet 326 in fluid communication with the second inlet 167 of the tub 104. The duct 320 may include two distinct passages therethrough, e.g., a first channel 336 extending from the inlet 322 of the duct 320 to the first outlet 324 of the duct 320 and a second channel 338 extending from the inlet 322 of the duct 320 to the second outlet 326 of the duct 320.

Figure 23:
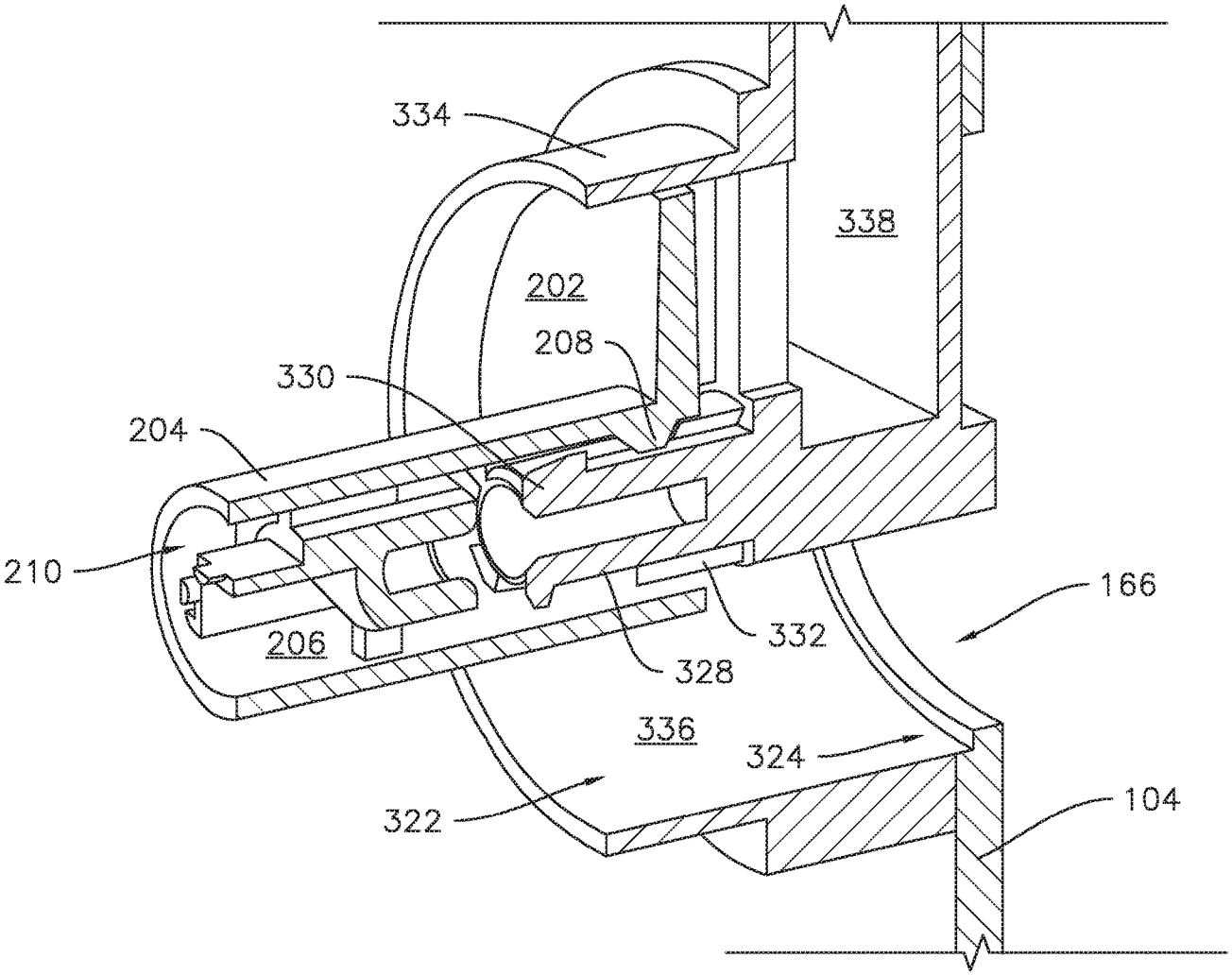
FIG. 23 provides a perspective view of a portion of the dishwashing appliance of FIG. 21 with the diverter in the first position.
Figure 24:
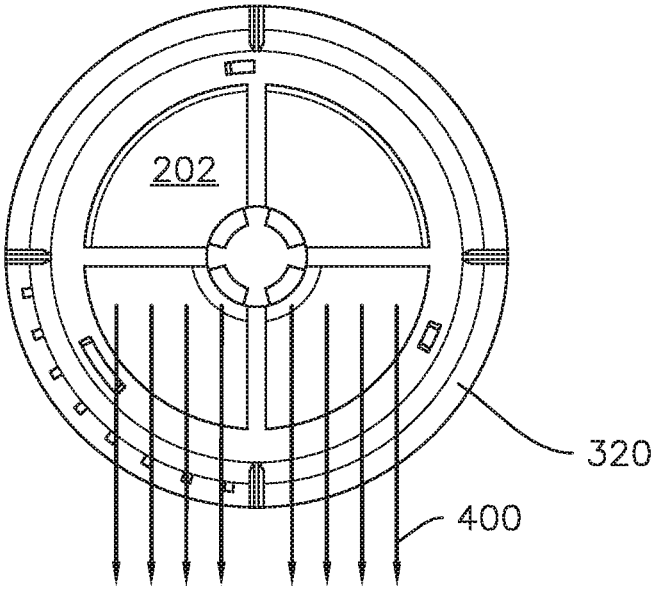
FIG. 24 provides a front view of the air distribution system of FIG. 21 in the first position.
Figure 25:
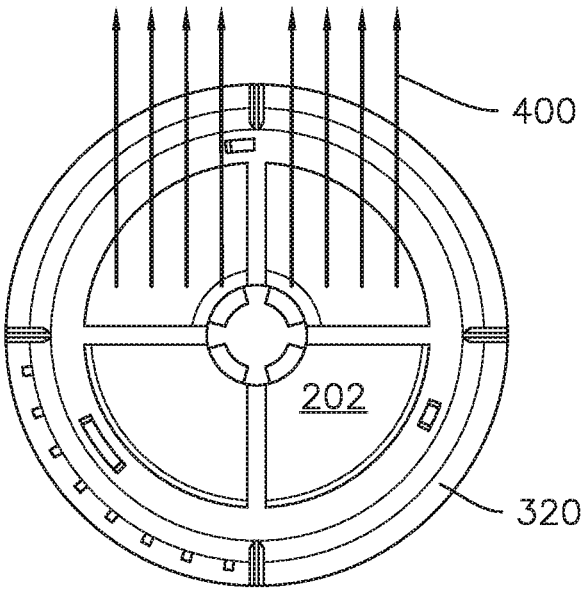
FIG. 25 provides a front view of the air distribution system of FIG. 21 in a second position.

As shown in FIGS. 22 through 26, in embodiments where the dishwashing appliance 100 includes the bi-passage duct 320, the diverter disk 202 may be semi-circular and may be rotatable about one hundred and eighty degrees between a first position and a second position. As shown in FIGS. 22 through 24, when the diverter disk 202 is in the first position, the diverter disk 202 permits air 400 to flow into the wash chamber 106 from the duct 320 via the first inlet 166 of the tub 104. For example, the dishwashing appliance 100 may include a fan 250 (FIG. 22) configured to urge the air 400 from an ambient environment around the dishwashing appliance 100 through the inlet 322. The diverter disk 202 obstructs the second channel 338 of the duct 320 when in the first position such that air 400 flows from the inlet 322 of the duct 320 through the first channel 336 and to the first outlet 326. Thus, when the diverter disk 202 is in the first position, the fan 250 urges the air 400 into the first inlet 166 in the tub 104 via the first channel 336 of the duct 320. As shown in FIGS. 25 and 26, when the diverter disk 202 is in the second position, the diverter disk 202 permits air 400 to flow into the wash chamber 106 from the duct 320 via the second inlet 167 of the tub 104. As shown for example in FIG. 26, when the diverter disk 200 is in the second position, air 400 urged from the ambient environment by the fan 250 may flow from the inlet 322 of the duct 320 into the second channel 338 of the duct 320 and to the second outlet 326 of the duct 320. Thus, when the diverter disk 202 is in the second position, the fan 250 urges the air 400 into the second inlet 167 in the tub 104 via the second channel 338 of the duct 320.

As mentioned above, the cylindrical shaft 204 of the diverter disk 202 may be configured to interengage with guide elements 320 and 322, which in some embodiments are disposed on the boss 310 of the vent 300 and in other embodiments are disposed on a boss 328 of the duct 320. As best seen in FIG. 23, the cylindrical shaft 204 may be hollow such that the cylindrical shaft 204 defines an interior channel 210 with an internal surface 206. The diverter disk 202 may further include a plurality of cams 208 disposed on the internal surface 206 of the cylindrical shaft 204 and projecting radially inward from the internal surface 206 of the cylindrical shaft 204 into interior channel 210. As best seen in FIG. 12, each cam 208 is spaced apart from adjacent cams 208 along the circumferential direction C, and each cam 208 is at the same axial position along the axial direction A. Accordingly, as described herein, one of skill in the art will appreciate that the guide elements 330, 332 and the cams 208 are configured to contact each other when the diverter disk 202 moves along the axial direction A so as to cause the diverter disk 202 to rotate incrementally through a plurality of angular positions, e.g., to rotate forty five degrees as diverter disk 202 travels in a first direction along the axial direction and to rotate an additional forty five degrees when the diverter disk 202 travels in a second direction opposite the first direction, thereby completing a ninety-degree rotation, such as from the first position of FIG. 7 to the second position of FIG. 8.

The air distribution assembly 200 may be configured to provide generally the same air flow rate into the wash chamber 106 when the diverter disk 202 is in either of the first position and the second position. For example, the fan 250 may be configured to urge the air 400 through the duct 320 at a higher speed when the diverter disk 202 in in the second position than when the diverter disk 202 is in the first position. As best seen in FIGS. 21 and 26, the second channel 338 is significantly longer than the first channel 336, such that the increased speed of the fan 250 when the diverter disk 202 is in the second position may accommodate or offset the additional distance and vertical climb before reaching the second inlet 167. Thus, the air flow rate at the second inlet 167 when the diverter disk 202 is in the second position may be about the same as the air flow rate at the first inlet 166 when the diverter disk 202 is in the first position.

As mentioned above, features illustrated or described as part of one embodiment can be used with another embodiment to yield a still further embodiment. For example, the duct 320 of FIGS. 21 through 26 may be paired with a diverter disk 202 having a single ninety-degree aperture, such as the example embodiments of the diverter disk 202 illustrated in FIGS. 7 through 13. In such embodiments, the diverter disk 202 may be rotatable through four positions such that air flow is provided to the first channel 336 in the first and second position and is provided to the second channel 338 in the third and fourth position. The foregoing is just one example of many possible combinations of features according to the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

a first inlet defined in the tub and providing air flow into the wash chamber;

a second inlet defined in the tub and spaced apart from the first inlet along a vertical direction;

a duct comprising an inlet, a first outlet in fluid communication with the first inlet defined in the tub, and a second outlet in fluid communication with the second inlet defined in the tub;

a fan configured to urge air through the duct; and a diverter disk proximate the first inlet downstream of the fan and upstream of the wash chamber, the diverter disk rotatable between a first position and a second position, wherein the diverter disk permits air flow into the wash chamber in a first air flow direction through the duct to the first inlet when the diverter disk is in the first position and in a second air flow direction through the duct to the second inlet when the diverter disk is in the second position, and wherein the diverter disk is configured to rotate between the first position and the second position in response to a flow of air from the fan.

2. The dishwashing appliance of claim 1, wherein the diverter disk defines an axial direction, the diverter disk rotatable about the axial direction between the first position and the second position.

3. The dishwashing appliance of claim 2, wherein the diverter disk is configured to translate along the axial direction in a first translation direction in response to the air urged by the fan.

4. The dishwashing appliance of claim 3, further comprising a biasing element, the biasing element configured and arranged to bias the diverter disk along the axial direction in a second translation direction opposite the first translation direction.

5. The dishwashing appliance of claim 3, wherein the dishwashing appliance defines a vertical direction, and the axial direction of the diverter disk is oblique to the vertical direction, whereby the diverter disk is configured to translate along the axial direction in a second translation direction opposite the first translation direction due to gravity.

6. The dishwashing appliance of claim 1, further comprising a vent positioned at the first inlet, the vent comprising a plurality of swirler vanes.

7. The dishwashing appliance of claim 1, wherein the diverter disk defines a circumferential direction, and wherein the diverter disk comprises an aperture, the aperture extending along an arc of approximately ninety degrees along the circumferential direction.

8. The dishwashing appliance of claim 7, wherein the aperture is a first aperture and the diverter disk further comprises a second aperture diametrically opposite the first aperture along a diameter of the diverter disk, the second aperture extending along an equivalent arcuate extent as the first aperture.

9. The dishwashing appliance of claim 1, further comprising a vent positioned at the first inlet defined in the tub, and wherein the diverter disk further comprises an external cylindrical surface and a helical groove extending around the external cylindrical surface, and wherein the vent comprises an internal cylindrical surface and a helical thread on the internal cylindrical surface configured to engage the helical groove on the external cylindrical surface of the diverter disk.

10. The dishwashing appliance of claim 1, wherein the diverter disk is further rotatable between a third position and fourth position, wherein the diverter disk permits air flow into the wash chamber via the inlet in a third direction when the diverter disk is in the third position and in a fourth direction when the diverter disk is in the fourth position, and wherein the diverter disk is configured to provide generally the same air flow rate into the wash chamber in each of the third direction and the fourth direction.

11. A dishwashing appliance defining a vertical direction, a lateral direction, and a transverse direction that are mutually perpendicular, the dishwasher appliance comprising:

a tub defining a wash chamber;

a first inlet defined in the tub and providing air flow into a lower region of the wash chamber;

a second inlet defined in the tub spaced apart from the first inlet along the vertical direction and providing air flow into an upper region of the wash chamber;

a duct comprising an inlet, a first outlet in fluid communication with the first inlet of the tub, and a second outlet in fluid communication with the second inlet of the tub; and a fan configured to urge air through the duct.

12. The dishwashing appliance of claim 11, further comprising a diverter disk positioned upstream of the first outlet and the second outlet, the diverter disk rotatable between a first position and a second position, wherein the diverter disk permits air flow into the wash chamber from the duct via the first inlet of the tub when the diverter disk is in the first position and permits air flow into the wash chamber from the duct via the second inlet of the tub when the diverter disk is in the second position.

13. The dishwashing appliance of claim 12, wherein the diverter disk further comprises a cylindrical shaft defining an interior channel having a plurality of cams disposed on an internal surface of the cylindrical shaft and projecting radially inward from the internal surface of the cylindrical shaft, and wherein the inlet of the duct further comprises a boss with a plurality of guide elements extending radially outward from the boss wherein the guide elements and the cams are configured to contact each other so as to cause the diverter disk to rotate between the first position and the second position.

14. The dishwashing appliance of claim 11, wherein the fan is configured to urge the air through the duct at a higher speed when the diverter disk in in the second position than when the diverter disk is in the first position.

15. The dishwashing appliance of claim 11, wherein the diverter disk defines an axial direction, the diverter disk rotatable about the axial direction between the first position and the second position, and the diverter disk is configured to translate along the axial direction in a first direction in response to the air urged by the fan.

16. The dishwashing appliance of claim 15, further comprising a biasing element, the biasing element configured and arranged to bias the diverter disk along the axial direction in a second direction opposite the first direction.

* * * * *